US011596243B2

(12) United States Patent
Roberts

(10) Patent No.: US 11,596,243 B2
(45) Date of Patent: Mar. 7, 2023

(54) ROCKING AND BOUNCING CHAIR

(71) Applicant: Dianna Lynn Roberts, Corona del Mar, CA (US)

(72) Inventor: Dianna Lynn Roberts, Corona del Mar, CA (US)

(73) Assignee: Dianna Lynn Roberts, Corona del Mar, CA (US)

( * ) Notice: Subject to any disclaimer, the term of this patent is extended or adjusted under 35 U.S.C. 154(b) by 0 days.

(21) Appl. No.: 17/350,570

(22) Filed: Jun. 17, 2021

(65) Prior Publication Data

US 2021/0393051 A1 Dec. 23, 2021

Related U.S. Application Data

(60) Provisional application No. 63/040,432, filed on Jun. 17, 2020.

(51) Int. Cl.

| | |
|---|---|
| ***A47D 13/10*** | (2006.01) |
| ***A63B 41/00*** | (2006.01) |
| ***A47C 3/029*** | (2006.01) |
| ***A47C 4/54*** | (2006.01) |

(52) U.S. Cl.

CPC ..... *A47D 13/102* (2013.01); *A47C 3/029* (2013.01); *A47C 4/54* (2013.01); *A63B 41/125* (2020.08); *A63B 2210/02* (2013.01)

(58) Field of Classification Search

CPC ..... A63B 41/125; A63B 2210/02; A47C 4/54; A47C 3/029; A47D 13/107; A47D 13/102

USPC ..... 297/259.1

See application file for complete search history.

(56) References Cited

U.S. PATENT DOCUMENTS

| | | | | |
|---|---|---|---|---|
| 1,317,580 A | | 9/1919 | Kanode | |
| 3,331,631 A | * | 7/1967 | Pierson, Jr. | A47D 13/107 297/259.4 |
| 5,915,407 A | * | 6/1999 | West | F16K 15/202 446/224 |
| 6,299,247 B1 | * | 10/2001 | Meeker | A47D 13/102 297/137 |
| 6,832,817 B1 | | 12/2004 | Chiu | |

(Continued)

FOREIGN PATENT DOCUMENTS

| | | | |
|---|---|---|---|
| CN | 108201260 A | * | 6/2018 |
| KR | 20130052104 A | * | 5/2013 |
| WO | WO 01/24887 | | 4/2001 |

OTHER PUBLICATIONS

Website for Gaiam Balance Chair, https://www.gaiam.com/products/classic-balance-ball-chair?variant=32936592449, Apr. 21, 2022, original date unknown, author unknown.

*Primary Examiner* — Milton Nelson, Jr.

(57) ABSTRACT

A chair facilitates both rocking and bouncing. The chair includes a base adapted to support a seating portion, the seating portion having a surface adapted to be sat on by a user. The seating portion has a bouncing mechanism, such as an exercise ball. A rocking mechanism is provided to cause the base to rock. The rocking mechanism facilitates the rocking back and forth of the user when the user is seated on the seating portion, and the bouncing mechanism facilitates the bouncing of the user when the user is seated on the seating portion. The bouncing is in a bouncing direction that is different than the direction of rocking. The chair is particularly useful for calming a baby and/or for facilitating stimming.

20 Claims, 8 Drawing Sheets

(56) References Cited

U.S. PATENT DOCUMENTS

| | | | | |
|---|---|---|---|---|
| 7,044,558 | B2 | 5/2006 | Chiu | |
| 7,475,442 | B1 * | 1/2009 | Dierking | A47C 3/16 297/452.41 |
| 7,691,036 | B1 * | 4/2010 | Julian | A63B 26/00 482/110 |
| D635,373 | S | 4/2011 | Lieberman | |
| 8,056,976 | B1 | 11/2011 | Polk | |
| D653,478 | S * | 2/2012 | Soewondo | D6/708.15 |
| D669,280 | S * | 10/2012 | Andersson | D6/379 |
| 8,919,881 | B2 | 12/2014 | Bay | |
| D783,301 | S | 4/2017 | Hsu | |
| D801,713 | S | 11/2017 | Chiu | |
| 9,919,185 | B1 | 3/2018 | Bo | |
| D819,356 | S | 6/2018 | Borak | |
| D865,389 | S | 11/2019 | Hefti | |
| 2008/0176727 | A1 * | 7/2008 | Heitzman | A47C 9/002 482/142 |
| 2010/0259083 | A1 | 10/2010 | Aminian | |
| 2011/0306476 | A1 | 12/2011 | Baptiste | |
| 2015/0042135 | A1 | 2/2015 | Lazelere | |
| 2016/0058202 | A1 * | 3/2016 | Drake | A47C 4/54 297/258.1 |
| 2017/0120111 | A1 * | 5/2017 | McBride | A63B 23/1227 |

* cited by examiner

ROCKING AND BOUNCING CHAIR

PRIORITY

The present application claims the benefit of domestic priority based on United States Provisional Patent Application 63/040,432 filed on Jun. 17, 2020, the entirety of which is incorporated herein by reference.

BACKGROUND

Since the dawn of the human race, parents have struggled to find the best way to calm a crying baby. There is perhaps no more tiresome and frustrating aspect of parenting than getting an agitated or excited baby to relax.

Parents and caregivers will go to amazing and extreme lengths to calm a crying child. For example, it is not unusual for a parent to drive around the block for hours because of the soothing effect a car seat provides a baby. Another parent may spend half the night gently pacing back and forth across a room to get a baby into a calmed state and then to keep the baby in that state. Often these extreme measures are only temporary solutions though. When the child is removed from the car seat or when the child is laid in bed, the child will many times awaken and start crying again.

One traditional approach to calming a baby involves rocking. In its simplest form, a baby can be rocked in the arms of a parent or caregiver. While soothing for the baby, fatigue inevitably sets in for the parent or caregiver after a certain period of time. Alternatively, a rocking chair can be used to provide the rocking motion to the baby. However, the motions that can be imparted by a rocking chair are limited, and if a parent or caregiver wants to change the motion being applied, the parent or caregiver must get out of the chair in a movement that can be disruptive and/or awakening for the baby.

Another approach to calming a baby involves gently bouncing the baby. This can also be performed in the arms of a parent or caregiver, but this can be exhausting for the parent or caregiver if this approach is required for an extended period of time. Bouncers have been developed that do not require a parent or caretaker physical participation to assist with the bouncing motion. However, conventional bouncers suffer from the drawback of being difficult or awkward to get the baby into and/or out of as well as lack the bonding benefits of parent to baby body to body contact. Another method that is gaining popularity is the use of an exercise ball that allows a parent or caregiver to bounce and calm the baby with much less effort by bouncing up and down on the ball while in a seated position. While useful, the exercise ball alone is not ideal in that it is not entirely stable. Attempts have been made to make sitting on an exercise ball more stable by incorporating the ball into an office chair, as an example. However, the office chairs with ball seats do not permit the user enough variety of movements to be ideally useful for calming a baby, nor does it provide the back and arm rest support to make it comfortable for the parent or caretaker.

In addition to calming a baby, movement and the facilitation of movement is useful in other areas. For example, stimming is self-stimulating behaviors and movements, and is performed to different extents by nearly all individuals. Stimming can be effective in stimulating office work and/or to work through nervous energy. In addition, stimming is particularly prevalent in those with autism. Currently chairs are not designed to facilitate stimming in an ideal manner.

Therefore, there is a need for a chair that is useful in providing multiple types of movements. There is further a need for a chair that allows for both rocking movement and bouncing movement. There is further a need for a chair that is useful for calming a baby in an improved manner. There is further a need for a chair that allows a user to make multiple different movements simultaneously or separately without having to get out of the chair. There is further a need for a chair that facilitates stimming for an individual. There is further a need for a chair that facilitates stimming for an individual diagnosed with autism or the like.

SUMMARY

The present invention satisfies these needs. In one aspect of the invention, a chair is provided that provides or facilitates multiple types of movement.

In another aspect of the invention, a chair is provided that allows for both rocking movement and bouncing movement.

In another aspect of the invention, a chair is provided that is useful for calming a baby in an improved manner.

In another aspect of the invention, a chair is provided that is useful for stimulating and aiding in the development of the vestibular system of a baby or an older child.

In another aspect of the invention, a chair is provided that is useful for an individual that is stimming.

In another aspect of the invention, a chair is provided that is useful for an individual diagnosed with autism that is stimming.

In another aspect of the invention, a chair is provided that allows a user to make multiple different movements simultaneously or separately.

In another aspect of the invention, a chair is provided that allows a user to make multiple different movements simultaneously or separately without having to get out of the chair.

In another aspect of the invention, a chair comprises a rocking mechanism and a bouncing mechanism.

In another aspect of the invention, a chair comprises a seating portion and a base portion. The base portion includes a body that supports the seating portion. The seating portion has a surface that is adapted to be sat on by a user so that the seating portion can support all or a portion of the weight of the user. The base portion also includes a rocking mechanism that allows the base portion to rock. The seating portion includes a bouncing mechanism that allows and/or encourages a user seated on the seating portion to bounce on the seating portion.

In another aspect of the invention, a chair comprises a rocking mechanism including one or more rails and a bouncing mechanism.

In another aspect of the invention, a chair comprises a rocking mechanism including a gliding mechanism and a bouncing mechanism.

In another aspect of the invention, a chair comprises a rocking mechanism and a bouncing mechanism, wherein the bouncing mechanism comprises an at least partially round or spherical member.

In another aspect of the invention, a chair comprises a rocking mechanism and a bouncing mechanism, wherein the bouncing mechanism comprises an at least partially round or spherical member that has an interior that can be inflated with air or the like to create internal pressure.

In another aspect of the invention, a chair comprises a rocking mechanism and a bouncing mechanism, wherein the bouncing mechanism comprises an at least partially round or spherical member that has an interior that can be inflated with air or the like to create internal pressure, wherein when a user sits on the member, the member becomes compressed and a force from the compression and the internal pressure presses against the user, so that the when the user sits down on the member, the member pushes back against the user in a manner that encourages the user to bounce back in the direction opposite of the sit.

In another aspect of the invention, a chair comprises a rocking mechanism, a bouncing mechanism, and one or more of a back rest, a head rest, and an arm rest.

In another aspect of the invention, a kit is provided for converting a rocking chair into a chair comprising a rocking mechanism and a bouncing mechanism.

In another aspect of the invention, a method of using a chair comprises selectively rocking in the chair or bouncing on the chair.

In another aspect of the invention, a method of using a chair comprises simultaneously rocking and bouncing on the chair.

In another aspect of the invention, a method of using a chair comprises selectively rocking in the chair, bouncing one the chair, or simultaneously rocking in the chair and bouncing on the chair.

In another aspect of the invention, a method of using a chair comprises sitting on the chair while holding a baby and selectively rocking in the chair or bouncing on the chair.

In another aspect of the invention, a method of using a chair comprises sitting on the chair while holding a baby and simultaneously rocking and bouncing on the chair.

In another aspect of the invention, a method of using a chair comprises sitting on the chair while holding a baby and selectively rocking in the chair, bouncing on the chair, or simultaneously rocking in the chair and bouncing on the chair.

In another aspect of the invention, a method of using a chair comprises sitting on a chair and using the chair to rock in a forward and backward direction and previously, at the same time, or thereafter bouncing in a different direction.

In another aspect of the invention, a chair for facilitating rocking and bouncing comprises a base adapted to support a seating portion, the seating portion having a surface adapted to be sat on by a user, the seating portion comprising a bouncing mechanism; and a rocking mechanism adapted to cause the base to rock, wherein the rocking mechanism facilitates the rocking back and forth of the user when the user is seated on the seating portion and wherein the bouncing mechanism facilitates the bouncing of the user when the user is seated on the seating portion, the bouncing being in a bouncing direction that is different than the direction of rocking.

In another aspect of the invention, a rocking and bouncing system for facilitating rocking and bouncing comprises a compressible exercise ball; a base adapted to receive the exercise ball in a manner so that the exercise ball has a seating portion, the seating portion having a surface adapted to be sat on by a user; and a rocking mechanism adapted to cause the base to rock, wherein the rocking mechanism facilitates the rocking back and forth of the user when the user is seated on the seating portion and wherein the exercise ball facilitates the bouncing of the user when the user is seated on the seating portion.

In another aspect of the invention, a method for facilitating a rocking motion and a bouncing motion of a user comprises providing a base having a seating portion and a rocking mechanism, the seating portion having a bouncing mechanism; having a user sit on the seating portion; rocking the base and the user seated on the seating portion; before, during or after rocking the base, facilitating the bouncing of the user on the seating portion.

DRAWINGS

These features, aspects, and advantages of the present invention will become better understood with regard to the following description, appended claims, and accompanying drawings which illustrate exemplary features of the invention. However, it is to be understood that each of the features can be used in the invention in general, not merely in the context of the particular drawings, and the invention includes any combination of these features, where:

DESCRIPTION

The present invention relates to a chair. In particular, the invention relates to a chair that allows for a combination of movements. Although the chair is illustrated and described in the context of being useful for rocking and bouncing a child while a user such as a parent or caregiver is in seated position and holding the child, the present invention can be useful in other instances. Accordingly, the present invention is not intended to be limited to the examples and embodiments described herein.

Figure 1A:
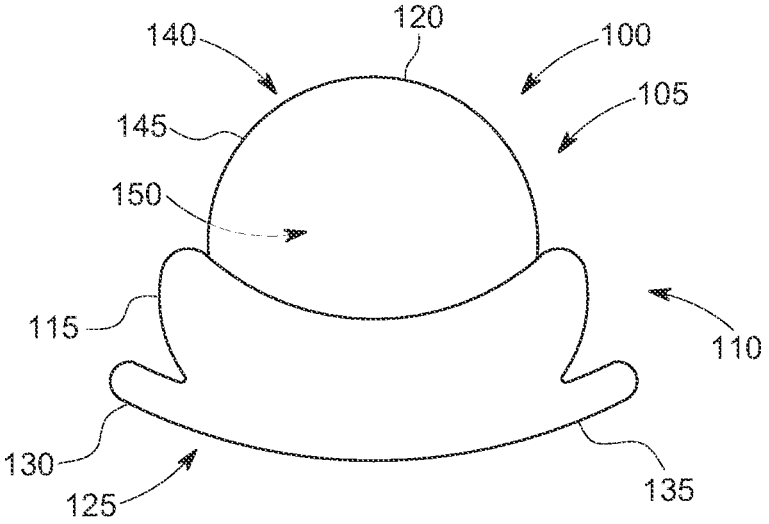
FIG. 1A is a schematic side view of a version of a chair of the invention.

FIG. 1A shows a side view of a chair 100 of the present invention in the form of a rocking and bouncing chair. The chair 100 includes a seating portion 105 and a base portion 110. The base portion 110 includes a body 115 that supports the seating portion 105 a predetermined height above the ground. The seating portion 105 has a surface 120 that is adapted to be sat on by a user so that the seating portion 105 can support all or a portion of the weight of the user.

The body 115 of the base portion 110 includes a rocking mechanism 125 that allows the base portion 110 and subsequently the seating portion 105 and anyone seated on the seating portion to rock. By rocking mechanism it is meant any mechanism that causes the seating portion 105 and/or a user seated on the seating portion 105 to rock, such as by causing the seating portion 105 and/or a user seated on the seating portion to move to and fro, or in the forward and backward direction, either in a straight line or in an arcuate or rotational motion. For example, in the version shown in FIG. 1A, the rocking mechanism 125 can comprise one or more rails 130, or rocker rails, that rest on the ground or other surface and that support the rest of the base portion 110. A bottom surface 135 of the rails 130 has an arcuate shape so that the seating portion 105 can rock back and forth by moving in a straight line or rotating along an arc as a different portion of the bottom surface 135 contacts the ground or other surface. Alternatively, the rocking mechanism 125 can comprise a gliding mechanism that causes the seating portion to move in more of a straight line manner forward and backward.

The seating portion 105 includes a bouncing mechanism 140. The bouncing mechanism facilitates by allowing and/or encouraging a user seated on the seating portion 105 to bounce on the seating portion 105. By bounce it is meant that the user can move back and forth in one or more directions. Preferably, the one or more bouncing directions are directions other than the movement caused by the rocking mechanism 125. For example, the bouncing direction can be up and down or along any line angled relative to the up and down direction. In the version of FIG. 1A, the bouncing mechanism 140 can be provided by a flexible and at least partially round or spherical member 145 that includes the surface 120 to be sat on. The member 145 has an interior 150 that can be inflated with air or the like to create internal pressure that exerts outwardly on the member 145. When a user sits on the surface 120, the member 145 becomes compressed and a force from the compression and the internal pressure presses against the user. In this way, the member 145 provides a cushioned seat for the user that can exhibit a dampening effect. In addition, the flexible and/or elastic nature of the member 145 and the internal pressure within the member 145 can create a spring-like effect on the user. When the user sits down on the member 145, the member 145 pushes back against the user in a manner that encourages the user to bounce back in the direction opposite of the sit. Thus, a user can bounce up and down by using the user's weight to compress the member 145 downward and then be forced or rebounded back upward by the member 145. The user could also or alternatively bounce in a more sideways direction. This can be done repeatedly and at a desired speed, velocity, and/or frequency. Alternatively, the bouncing mechanism 140 could be a mechanism that allows bounce movement back and forth in a single direction or arc.

Together the rocking mechanism 125 and the bouncing mechanism 140 provide a user seated on the seating portion 105 of the chair 100 with the ability to move back and forth in two or more different directions in an assisted manner. The directions can relate to a line, an arc, or a combination of a line and an arc. For example, in the specific version of FIG. 1A, the user can rock back and forth in a forward direction and simultaneously bounce in an up and down direction or in any direction angled from the up and down direction.

In has been discovered that the chair 100 uniquely provides advantageous effects to a user of the chair 100. For example, the ability to simultaneously or alternatively move back and forth in different directions, such as by rocking forward and backwards and bouncing in a direction other than forward and backward, is particularly useful in calming a child being held by the user. Much like a car seat in a moving car, gentle bouncing while rocking provides a similar soothing effect and has been found to stop, reduce, and/or prevent a child from crying. It is believed that the movement provided to the baby from the use of the chair 100 can simulate the movements a baby experienced in the womb and can stimulate the vestibular system of the baby and provide either a calming or a stimulating effect depending upon the movement.

The chair 100 also provides additional benefits for the baby and/or the user sitting in the chair 100. For example, since some babies prefer at different times either a rocking motion or a bouncing motion or a combination of rocking and bouncing motion, the chair 100 provides a user of the chair 100 with the option of providing any of these movements to the baby or sitting still. This is particularly useful when a caregiver uses the bouncing motion to calm an excited baby in that as the baby calms, the caregiver can gradually transition into a rocking movement as the baby falls asleep. These options are provided to the user all while the user remains seated, eliminating the need for the user to stand to move from one chair to another or to walk around the room simulating a bouncing movement for the baby. Being able to remain seated can lower the stress on the back, muscles, or joints of a caregiver and can be particularly useful for new mothers who have recently undergone C-sections or episiotomies. In addition, the chair 100 can be useful for allowing a baby to be burped while the user holding the baby is seated, making the process more comfortable and less fatiguing for the user. Also, the bounding movement can strengthen the core and/or leg strength of the user over time with consistent use.

While the chair 100 is particularly useful for a user wishing to calm and/or stimulate a held baby, the chair 100 is useful for many other purposes and individuals. For example, in one version, the chair 100 can be used by senior or elderly individuals. A chair 100 having the combination of a traditional rocking motion and a comfortable, soft, elastic, ball seat with a bouncing mechanism with a back rest, head rest, and/or arm rest can be particularly useful for aiding with symptoms associated with arthritis, upper and lower back pain, decreased blood flow, weight loss, dementia, Alzheimer's, anxiety, insomnia, and depression. In addition, the chair 100 can be useful for personal home use, in a classroom, in a gym, and/or in a therapeutic/rehabilitation setting, such as a hospital maternity or NICU ward. The combination of rocking and bouncing can be particularly useful for people suffering from various injuries, upper and lower back pain, surgery recovery, aftermath of stroke symptoms. The chair 100 can also be useful for children old enough to sit on the chair 100 themselves. In these instances, children can use the chair 100 both for fun and to further develop and stimulate the vestibular system. In this regard, the size of the chair 100 can be adjusted to fit children. The chair 100 can also be used for women in labor. The chair is also useful for an individual who is stimming. Stimming is self-stimulating behavior and can include repetitive movements. Individuals can perform stimming for a number of reasons, such as to stimulate alertness and/or to work off nervous energy. Individuals diagnosed with autism or on the autistic spectrum also perform stimming, and the chair 100 is particularly useful for such individuals in that it allows for multiple movements to be performed simultaneously. The chair 100 is further useful for any other purpose where the combination of rocking and bouncing is beneficial or desirable.

Figure 1B:
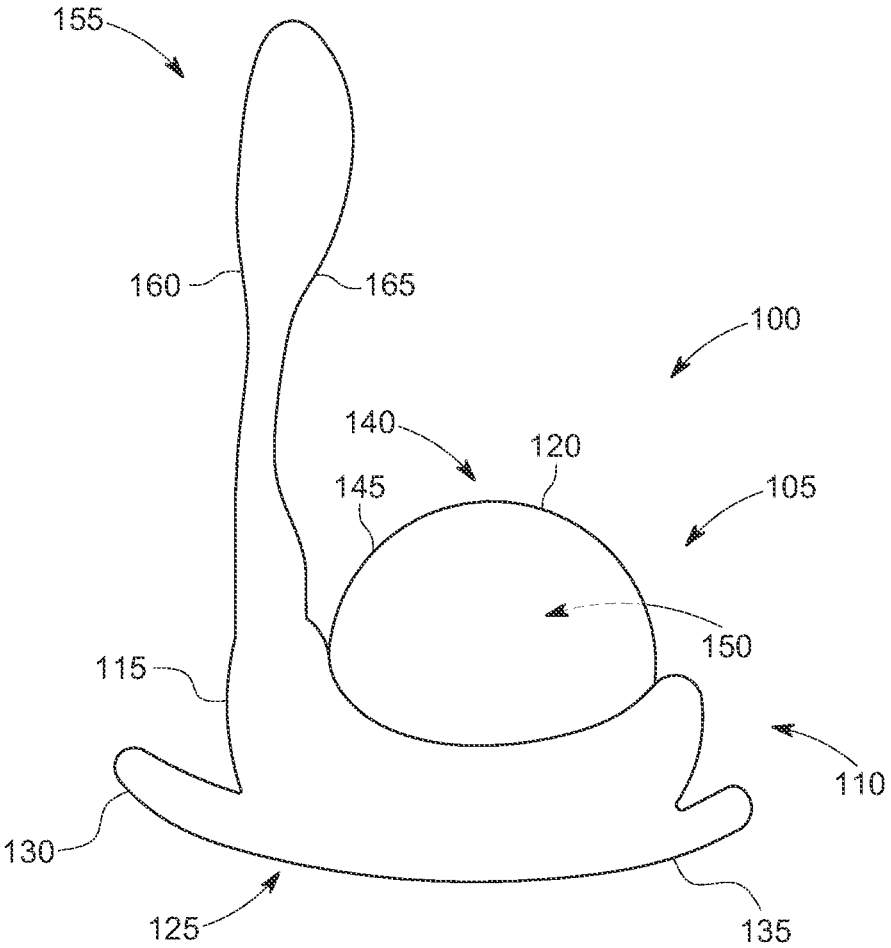
FIG. 1B is a schematic side view of another version of a chair of the invention.

FIG. 1B shows a version of the chair 100 of FIG. 1A equipped with an optional back rest 155. The back rest 155 includes an upwardly extending portion 160 extending from the body 115 of the base portion 110. The upwardly extending portion 160 has a back-engaging surface 165 on the front side thereof. With this version, a user sitting on the seating portion 105 can lean back onto the back-engaging surface 165 of the back rest 155 to obtain additional support. The back rest 155 can also help the user generate a rocking motion by being able to allow for the user to press backwardly onto the back rest to cause the rocking mechanism 125 to rock the chair 100. The backward force can be generated either by pressing against the ground with the user's feet and/or by generating momentum using the user's musculature. The back rest 155 can be sized and shaped so that the user is able to bounce on the bouncing mechanism 140 while engaging the back rest 155. However, in most instances, the user using the chair 100 will lean forward off of the back rest 155 while performing the bouncing movement.

Figure 2A:
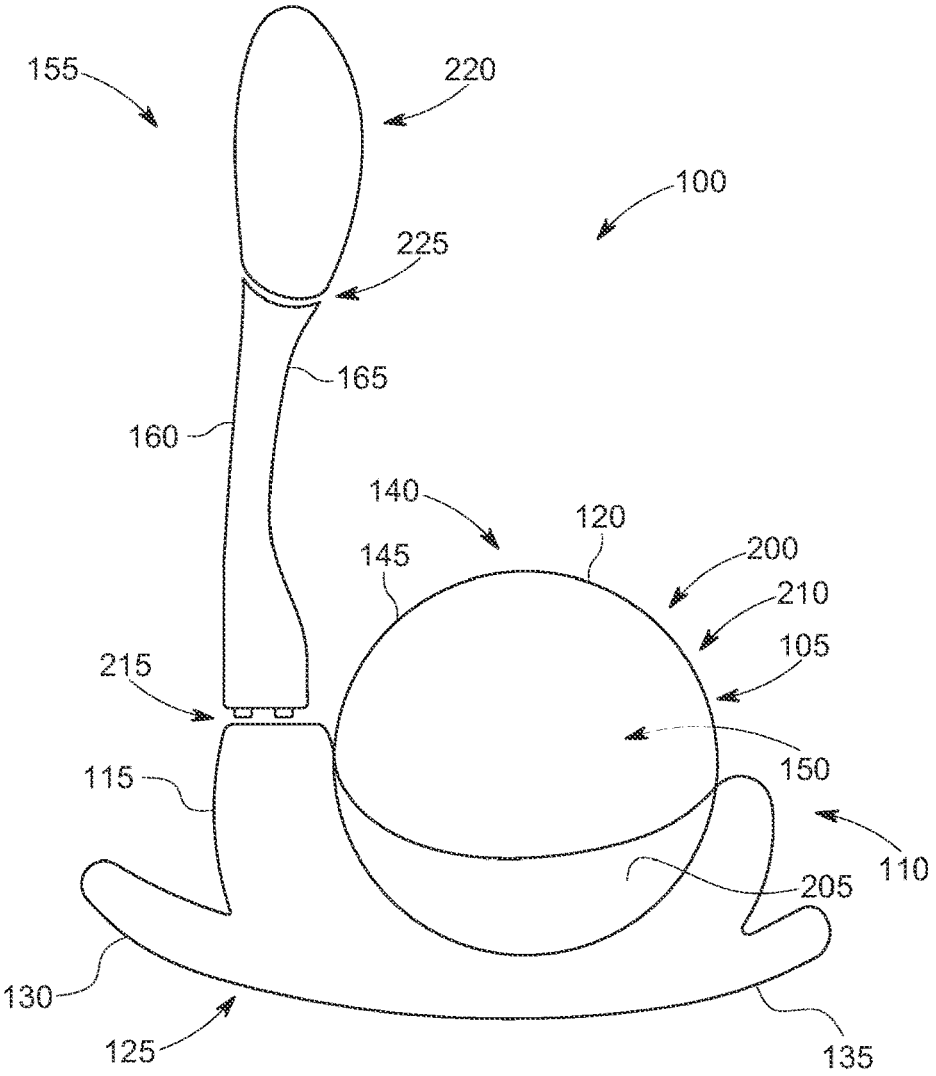
FIG. 2A is a schematic side view of another version of a chair of the invention.

FIG. 2A shows a version of the chair 100 of the invention that is similar to the version of FIGS. 1A and 1B, and with some additional and/or more specific features. In the version of FIG. 2A, the seating portion 105 and the bouncing mechanism 140 are provided by a round ball 200 that is sized, shaped, and designed to be contained within the body 115 of the base portion 110. For example, the body 115 of the base portion 100 can contain a cavity 205 that is sized and shaped to receive the round ball 200. For example, the cavity 205 can have a partially rounded surface of the same or similar size, diameter, or other cross-sectional dimension as the round ball 200. The round ball 200 can be removeably insertable into the cavity 205 or can be permanently contained therein. Alternatively, the cavity 205 can be an opening or recess sized to receive a portion of the round ball 200. The cavity 205 can be located at the top of the base 115 and/or at the bottom of the base 115.

In one version, the round ball 200 of the chair 100 is a spherical ball 210. The spherical ball 210 can have a diameter ranging from about 20 cm to about 110 cm, or from about 35 cm to about 85 cm, or in one particular version about 60 cm to about 70 cm. The spherical ball 210 can be made of any suitable material that is sufficiently strong to contain compressed air within its interior 150 and sufficiently flexible to be deformable when sat on. For example, the spherical ball 210 can be made of one or more of a vinyl, soft plastic vinyl, polyvinyl chloride, TPE, TPR, rubber, latex, phthalates, DEHP, DBP, BBP, DINP, DIDP, DNOP, non-rubber PVC, phenols, PAHS, silicon, recycled plastic, recycled rubber, thermoplastic polymer, polyethylene, polypropylene, polystyrene, polytetrafluoroethylene, and the like and may be transparent or translucent and may be a single layer or multiple layers. Optionally, the spherical ball 210 can be provided with an anti-burst feature. Alternatively, the round ball 200 can have a shape other than spherical. For example, the round ball 200 can be at least partially oval, ovoid, ovate, egg-shaped, tubular, cylindrical, cone-shaped, have a polygonal cross-sectional shape, convex, concave, and/or the like.

In one particular version, the spherical ball 200 can be or can be similar to a commercially available exercise ball. Exercise balls are also known as stability balls, yoga balls, fitness balls, balance balls, birth balls, gym balls, gymnastics balls, physio balls, pilates balls, naval mines, Pezzi balls, Swedish balls, therapy balls, body balls, bounce balls, bouncy balls, Swiss ball and examples of which are available from retailers such as Amazon.com as URBNfit, Trideer, Gaiam, BalanceFrom, Pro Body, Gal Sports, Black Mountain, YOGU, Arteesol, Valeo, Vitos, Inpany, SmarterLife, High Fly, and U-POWEX. The exercise balls are compressible spherical balls that can be filled with air so that they can be elastically compressed and bounced making them bouncy when sat upon. Exercise balls typically include a valve stem so that they can be filled with air or have air released therefrom. This allows for a variation in air pressure and a resulting variation in bounciness.

The parts of the chair 100 other than the round ball 200 can be made of any suitable material. For example, these parts can be made of one or more of wood, plastic, metal, aluminum, aluminum tubing, stainless steel, stainless steel tubing, compressed cardboard, recycled plastics, fabric, upholstered components, recycled metals, recycled aluminum, recycled rubber, nylon strapping, polyester strapping, and the like, and may or may not have a powder coating. The chair 100 can be made as an integrated unit or can be a system of separable parts. For example, in one version, the chair 100 is a system rocking and bouncing system that is made up of a base portion 110 in accordance with any version shown herein and a separate round member 200, such as a commercially available exercise ball. The round member 200 can be replaceably insertable on or into the base portion 110 to allow the round member 200 to serve as the seating portion 105 for the chair 100. In this regard, the chair 100 and/or system can be provided as the base portion 110 in combination with the round member 200 or the base portion 110 can be provided without a round member 200 so that a conventional or separate round member 200 is provided for use with the base portion 110.

Figure 2B:
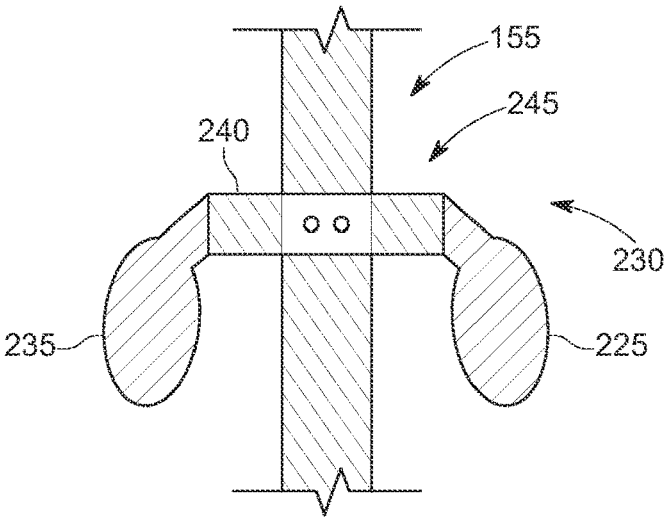
FIG. 2B is a schematic front view of a portion of another version of a chair of the invention.

FIGS. 2A and 2B also show additional features that can be provided on the back rest 155. For example, in the version of FIG. 2A, a detachment mechanism 215 can be provided to allow the back rest 155 to be selectively removeable from the body 115 of the base portion 110. In addition, the back rest 155 can be provided with a head rest 220 that provides additional support for the head of a user seated on the seating portion 105. Optionally, an extension mechanism 225 can be provided to allow the position of the head rest 220 to be adjustable, such as by being able to adjust the length of the back rest 155 by moving the head rest 220 toward or away from the rest of the back rest 155. As shown in FIG. 2B, the back rest 155 can further include an arm supporting member 230. The arm supporting member 230 includes two arm rests 235 extending from a support 240. The support 240 is attachable by attachment mechanism 245 to the back rest 155 at an attachment position 250 along the back rest 155. Alternatively, the arm supporting member 230 can be integrated with, permanently attached to, or formed in a single piece with the back rest 155. The back rest 155 and/or the head rest 220 can be adjustable in terms of vertical positioning. For example, the head rest 220 can be designed to be adjusted up or down, for example, by way of a pin/locking track system along the back rest 155. Alternatively or additionally, the arm rests 235 can be adjusted up or down by way of a pin/locking track system along the back rest 155. Optionally, the arm rests 235 may be flippable up and away vertically when the arm rests 235 are not desired by an internal hinge mechanism or the like. For example, the back rest 155 may be lengthened or shortened using a retractable or telescopic feature within the back rest 155.

Figure 3:
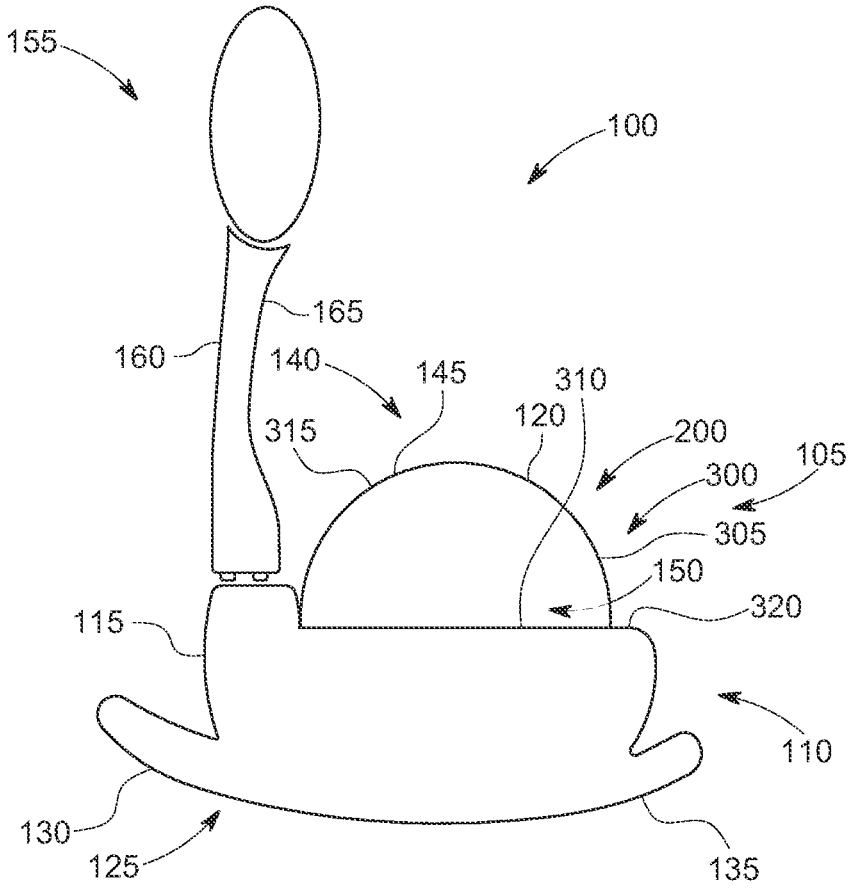
FIG. 3 is a schematic side view of another version of a chair of the invention.

FIG. 3 shows a version of the chair 100 of the invention that is similar to the version of FIGS. 1A, 1B, and 2A. In the version of FIG. 3, the seating portion 105 and the bouncing mechanism 140 are provided by a round ball 200 that is sized, shaped, and designed to be contained on or within the body 115 of the base portion 110. For example, the body 115 of the base portion 100 can secure, support, or receive the round ball 200 that is in the form of a partial sphere 300, and in the particular version shown is a substantially semi-spherical ball 305. The semi-spherical ball 305 has a surface 310, such as a bottom surface, that is different than the surface 315 of the portion of the ball that is semi-spherical. For example, the surface 310 in the version shown is substantially flat and is adapted to be positioned on a flat surface 320 of the body 115 of the base 110. Alternatively, the surface 310 of the ball and the surface 320 of the body 115 can be a shape other than flat, such as corresponding concave and convex surfaces. Also, optionally, the surface 320 of the base 115 can have a cavity 205, such as a recess or opening, within the base 115 that is sized and shaped to receive the semi-spherical ball 305.

The semi-spherical ball 305 can have dimensions similar to those discussed above for a spherical ball but accounting for the change of shape. For example, the semi-spherical ball 305 can have a diameter ranging from about 20 cm to about 110 cm, or from about 35 cm to about 85 cm, or in one particular version about 60 cm to about 70 cm in one direction and a length of about half of that in an orthogonal direction. The semi-spherical ball 305 can be made of any suitable material that is sufficiently strong to contain compressed air within its interior 150 and sufficiently flexible to be deformable when sat on. For example, the semi-spherical ball 305 can be made of one or more of a vinyl, soft plastic vinyl, polyvinyl chloride, TPE, TPR, rubber, latex, phthalates, DEHP, DBP, BBP, DINP, DIDP, DNOP, non-rubber PVC, phenols, PAHS, silicon, recycled plastic, recycled rubber, thermoplastic polymer, polyethylene, polypropylene, polystyrene, polytetrafluoroethylene, and the like and may be transparent or translucent and may be a single layer or multiple layers. Optionally, the semi-spherical 305 can be provided with an anti-burst feature. Alternatively, the round ball 200 can have a shape other than semi-spherical. For example, the round ball 200 can be at least partially semi-oval, semi-ovoid, semi-ovate, semi-egg-shaped, semi-tubular, semi-cylindrical, semi-cone-shaped, have a semi-polygonal cross-sectional shape, convex, concave, and/or the like.

Figure 4A:
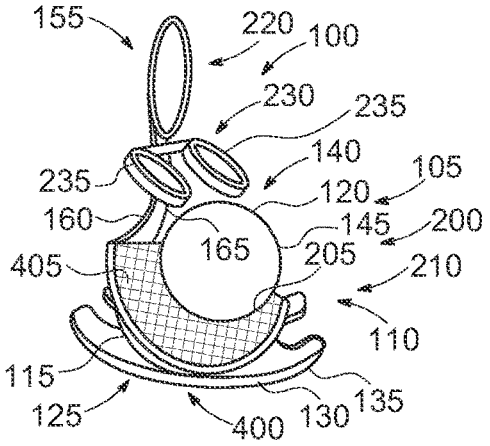
FIG. 4A is a schematic side view of another version of a chair of the invention.
Figure 4B:
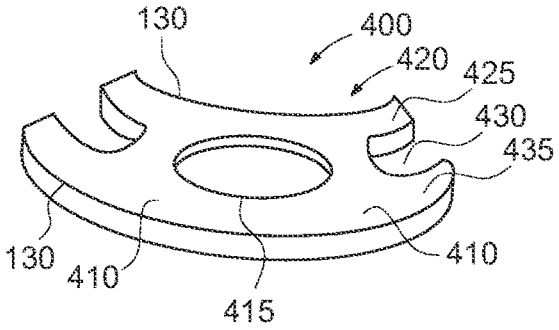
FIG. 4B is a schematic perspective view of a rocker base of the chair of FIG. 4A.
Figure 4C:
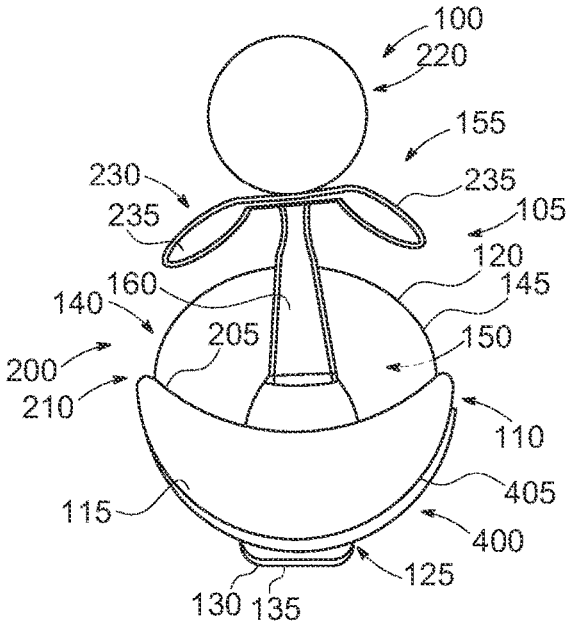
FIG. 4C is a schematic rear view of the chair of FIG. 4A.
Figure 4D:
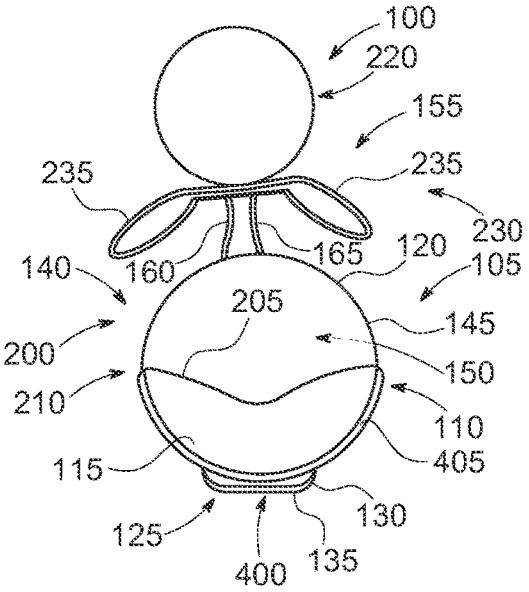
FIG. 4D is a schematic front view of the chair of FIG. 4A.

FIGS. 4A through 4D illustrate another version of a chair of the invention. In this version, the body 115 of the base portion 110 of the chair 100 includes a rocker base 400 attached to a seating portion supporting member 405. The seating portion supporting member 405 can, for example, include the cavity 205 for receiving the round ball 200. The rocker base 400, as shown in FIG. 4B, can be made up of one or more pieces that are connectable or permanently attachable to the seating portion supporting member 405 or can be formed in one piece therewith. In the particular version shown, the rocker base 400 can include two or more rails 130 that are connected by one or more cross supports 410. Optionally, a round opening 415 can be provided to receive a portion of the seating portion supporting member 405. Also, a front portion 420 of the rocker base 400 can be provided with one or more surfaces 425, 435 on which a user's foot or feet can be placed, and optionally a gap 430 can be provided between or near the surfaces 425, 435 so that a foot or both feet can be placed in the gap 430 to contact the ground.

Figure 5:
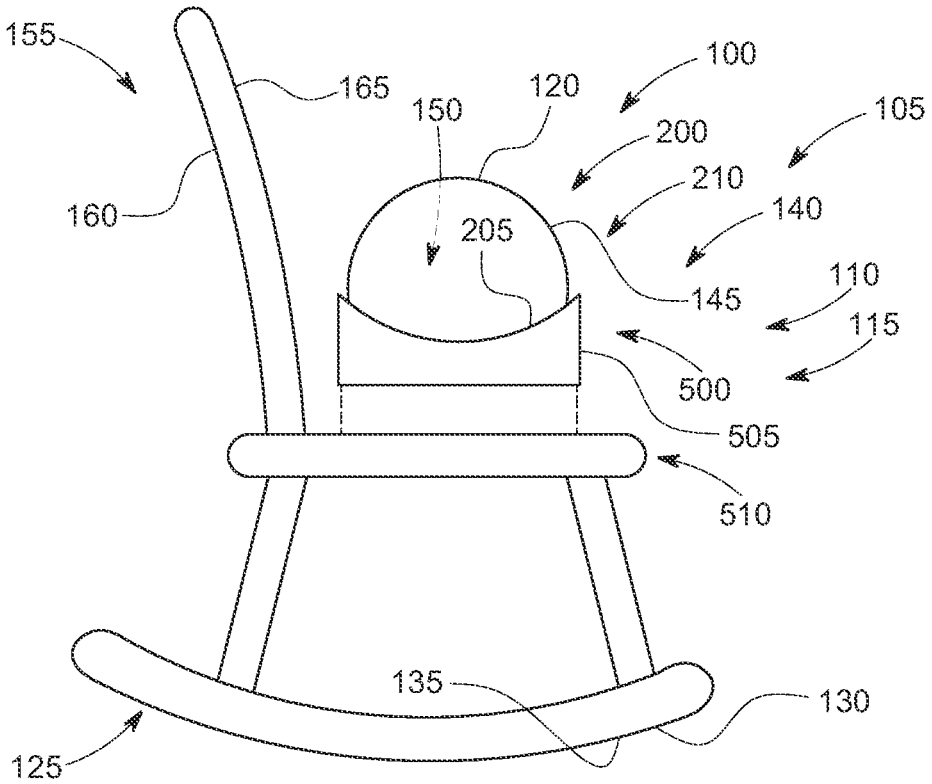
FIG. 5 is a schematic side view of another version of a chair of the invention.

FIG. 5 shows another version of a chair 100 of the invention. In this version, the chair 100 includes an adapter system 500 that allows a user to convert a conventional rocking chair into a chair 100 having the advantages discussed herein. The adapter system 500 includes an adapter body 505 that is a piece of material that can replace, be placed on top of, or placed within a seat 510 of the rocking chair. The adapter system 500 includes the cavity 205 for receiving the round ball 200. Using the adapter system 500 of FIG. 5, a user can convert an existing rocking chair into a chair 100 of the invention by merely purchasing an exercise ball or the like that fits within the cavity 205.

Figure 6A:
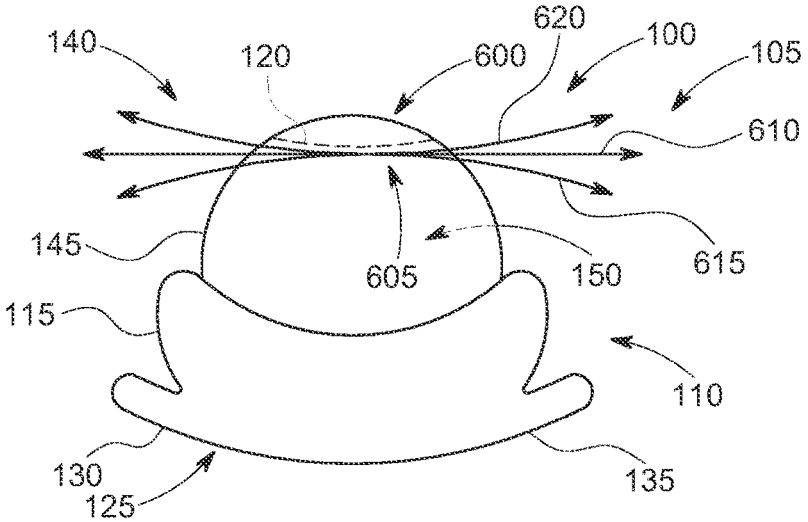
FIG. 6A is a schematic side view of a chair of the invention showing the rocking movement.
Figure 6B:
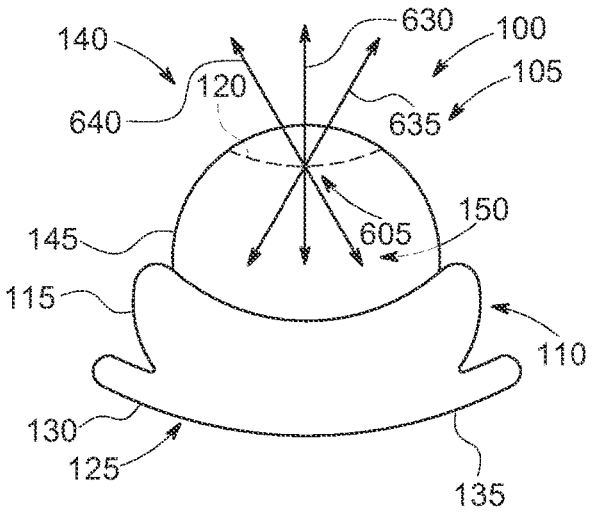
FIG. 6B is a schematic side view of a chair of the invention showing the bouncing movement.
Figure 6C:
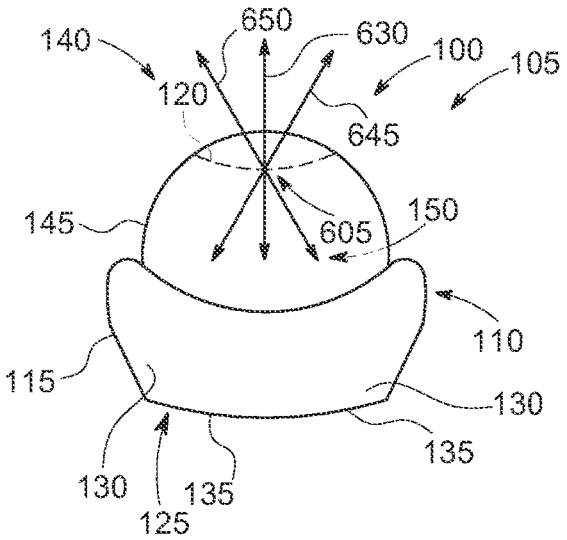
FIG. 6C is a schematic rear view of a chair of the invention showing the bouncing movement.

FIGS. 6A through 6C show in more detail the types of movements or combinations of movements that the chair 100 provides for a user of the chair 100. Together the rocking mechanism 125 and the bouncing mechanism 140 provide a user seated on the seating portion 105 of the chair 100 with the ability to move back and forth in two or more different directions, at the same time or at different times, in an assisted manner. For example, FIG. 6A illustrates versions of the rocking movement 600 or motion. A user seated on the seating portion 120 will compress the round or spherical member 145 to a position 605. The exact position 605 will depend on a number of factors, such as the size, material, and compressibility of the round or spherical member 145 and the weight, size, and shape of the user. From this position 605, the user can initiate the rocking movement 600 by causing the chair 100 to rock on its rocking mechanism 125. The rocking movement 600 can be in a substantially straight line 610, such as when a gliding mechanism is used as the rocking mechanism 125 or when rails 130 are designed with an arc shape that causes the straight line movement 610. Alternatively, the rocking mechanism 125 can be designed so that the rocking movement 600 is more of a downward arc 615 and/or more of an upward arc 620, depending on the shape of the rails 130 and/or the position 605 of the user. Thus, in general, the rocking movement 600 is meant to include any movement to and fro, including straight line and arced movement, where the movement is mostly in the horizontal direction and/or includes at least a portion of movement in a horizontal plane, including tangents to any arced movement that lie in the horizontal plane. The horizontal direction or the horizontal plane include the position 605 or any other point of the seating portion 120, such as the top of the round or spherical ball 140 or the center point thereof. The rocking movement 600 can be in the forward and backward or rearward direction, as shown in FIG. 6A when the rocking mechanism 125 is designed for such movement, or can be in more of a side to side movement when the rocking mechanism 125 is designed to allow for such. The described movements have been described relative to a user sitting in the chair 100 in the intended position. Clearly, a user can sit differently on the chair 100. For example, a user could sit sideways on the chair 100 of FIG. 6A and the rocking movement 600 would be side to side for the user in that position.

FIGS. 6B and 6C show examples of the bouncing movement 625 or motion from the position 605 or from any other point on the seating portion 120. The bouncing movement 625 can be in a straight up and down 630 direction, in a tilted forwarded 635 direction, in a tilted backwards 640 direction, in a tilted to the right 645 direction, and/or in a tilted to the left 650 direction. All of these directions can be in a straight line, slightly curved, or significantly curved. The bouncing movement 625 can also involve a combination of these directions. For example, the bouncing movement 625 can a bounce to the right along the tilted to the right 645 direction and then a bounce to the left along the tilted to the left 650 direction, and this movement can be repeated. The bouncing movement 625 can also include randomly bouncing in all directions and/or can include twisting movements. Thus, in general, the bouncing movement 625 is meant to include any movement up and down, including straight line and arced movement, where the movement is mostly in the vertical direction and/or includes at least a portion of movement in a vertical plane, including tangents to any arced movement that lie in the vertical plane. The vertical direction or the vertical plane can include the position 605 or any other point of the seating portion 120, such as the top of the round or spherical ball 140 or the center point thereof.

The chair 100 is designed to allow for any of the rocking movements 600 and/or any of the bouncing movements 625 to be performed by the user of the chair 100 in an assisted manner. The rocking mechanism 125 is designed to facilitate or assist in generating a rocking movement 600 and the bouncing mechanism 140 is designed to facilitate or assist in generating a bouncing movement. The user of the chair 100 can select to perform one or more of the rocking movements 600 and/or one or more of the bouncing movements 625. For example, a user can initially generate a bouncing movement 625 and thereafter can transition into a rocking movement 600 without the user having to change sitting position. Alternatively, a user can simultaneously generate a rocking movement 600 at the same time as generating a bouncing movement 625.

Figure 7A:
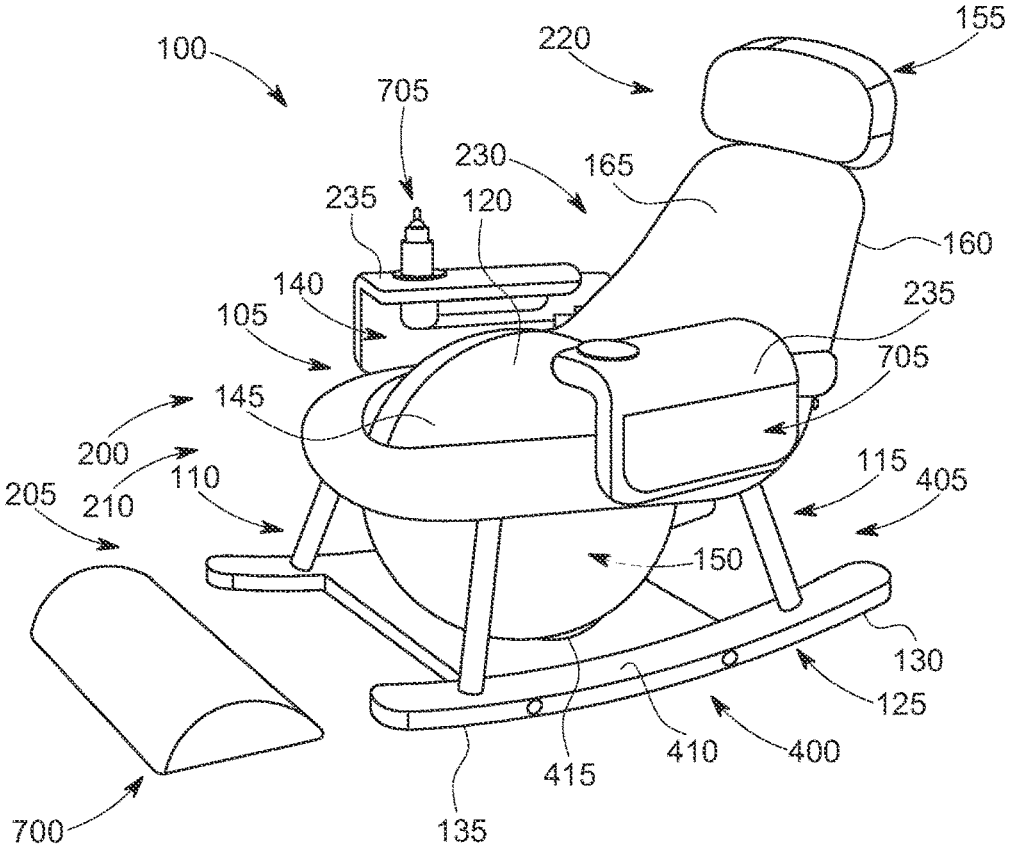
FIG. 7A is a schematic perspective view from the side of another version of a chair of the invention.
Figure 7B:
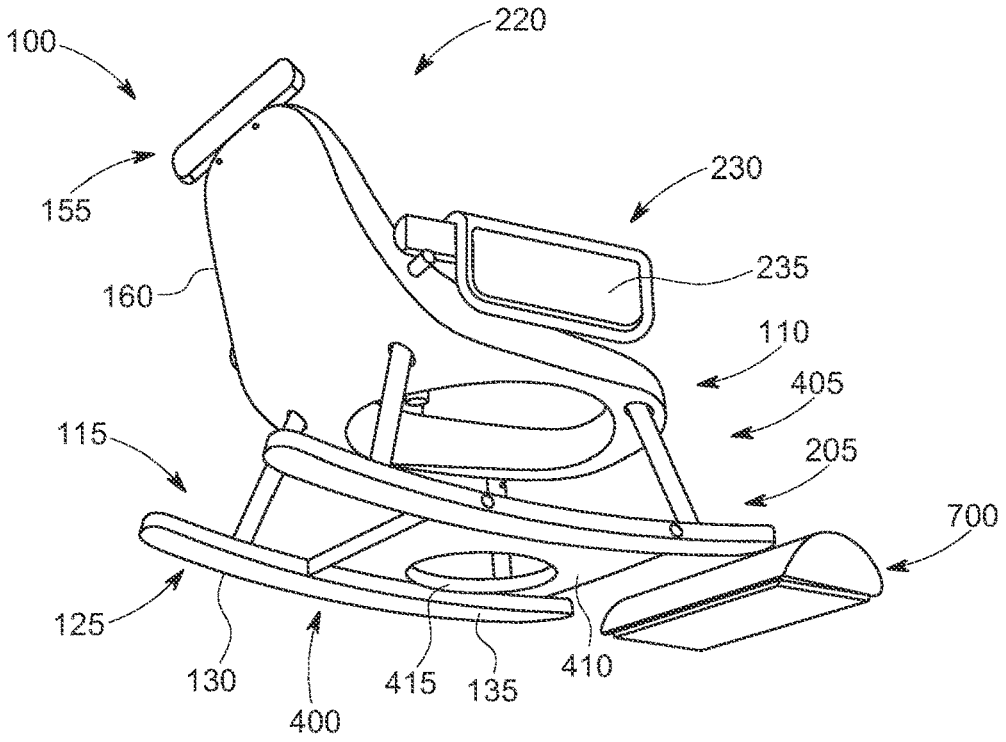
FIG. 7B is a schematic perspective bottom view of the chair of FIG. 7A.

A particular version of a chair 100 of the invention is shown in FIGS. 7A and 7B. In this version, the spherical ball 210 is removably insertable into the cavity 205 in the base 115. FIG. 7B shows the chair 100 without the spherical ball 210. Also, as shown in FIGS. 7A and 7B, a footrest 700 can optionally be provided. Also, one or more compartments 705 can be provided on the armrests 235.

Figure 8:
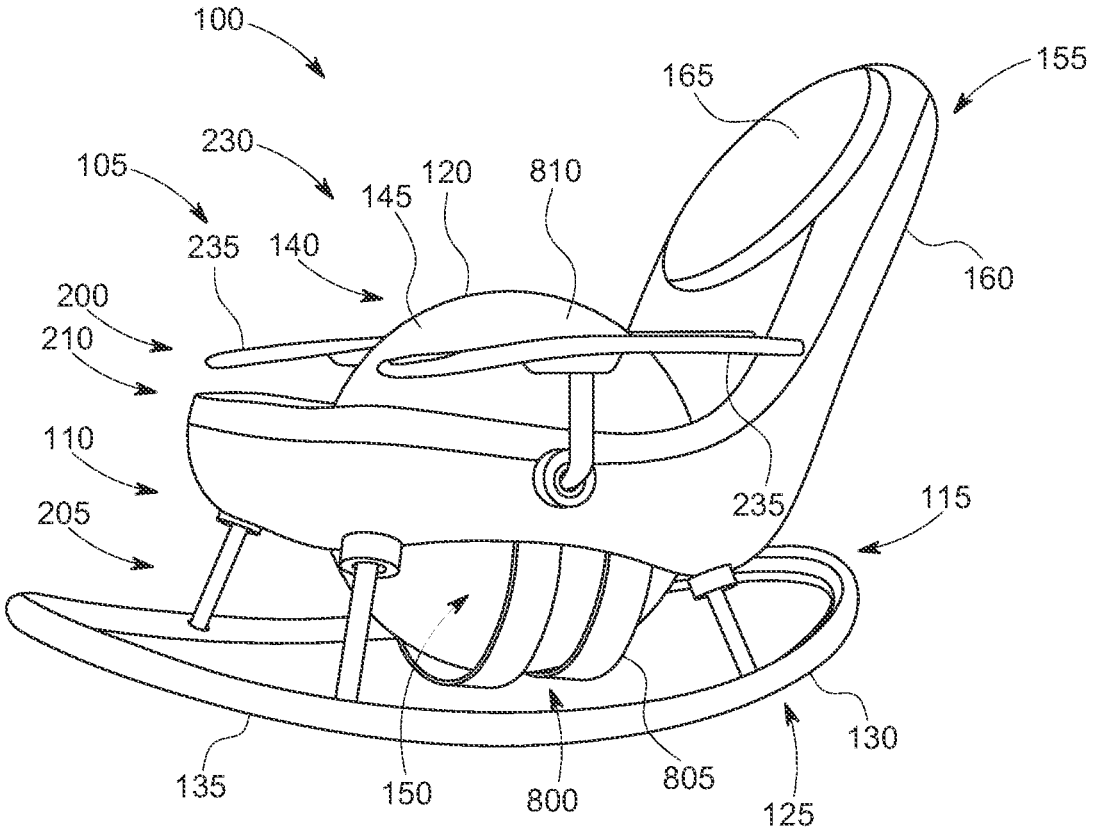
FIG. 8 is a schematic perspective view from the side of another version of a chair of the invention.

Another particular version of a chair 100 of the invention is shown in FIG. 8. In this version, a supporting mechanism 800 is provided in the cavity 205 to support the spherical ball 210. The supporting mechanism 800 in the version shown is made up of one or more flexible or non-flexible supporting straps 805 that are adapted to receive the spherical ball 210 in a supporting manner so the ball extends above the base 115 and can be sat on by a user. Also, optionally, a top layer of material 810 is a flexible mesh material made, for example, from latex, soft vinyl, or the like. The top layer of material 810 is intended to hold round member 200 in place while also acting as a barrier between the user and the round member 200. In this version, the surface 120 of the seating portion 105 is provided by the top layer of material 810.

Additional or alternative features will be apparent to those skilled in the art. For example, additional cushions can be provided on any of the surfaces of the chair 100 than the user may contact, such as the back rest, head rest, and/or arm rest. Additional features can also be incorporated into the chair 100. For example, the chair 100 can include one or more of a heated back rest, a massage or vibration mechanism, wired or wireless speakers, and the like, and such chair can be connected to a mobile app that controls the features of the chair 100 and that can be used to provide music, either of the user's choosing or automatically selected to be soothing or calming. The chair 100 can also be equipped with one or more sensors or detectors to detect a condition of the user, such as heartrate or the like.

Although the present invention has been described in considerable detail with regard to certain preferred versions thereof, other versions are possible, and alterations, permutations and equivalents of the version shown will become apparent to those skilled in the art upon a reading of the specification and study of the drawings. For example, the cooperating components may be reversed or provided in additional or fewer number, and all directional limitations, such as up and down and the like, can be switched, reversed, or changed as long as doing so is not prohibited by the language herein with regard to a particular version of the invention. Also, the various features of the versions herein can be combined in various ways to provide additional versions of the present invention. Furthermore, certain terminology has been used for the purposes of descriptive clarity, and not to limit the present invention. Throughout this specification and any claims appended hereto, unless the context makes it clear otherwise, the term "comprise" and its variations such as "comprises" and "comprising" should be understood to imply the inclusion of a stated element, limitation, or step but not the exclusion of any other elements, limitations, or steps. Throughout this specification and any claims appended hereto, unless the context makes it clear otherwise, the term "consisting of" and "consisting essentially of" and their variations such as "consists" should be understood to imply the inclusion of a stated element, limitation, or step and not the exclusion of any other elements, limitations, or steps or any other non-essential elements, limitations, or steps, respectively. Throughout the specification, any discussed on a combination of elements, limitations, or steps should be understood to include a disclosure of additional elements, limitations, or steps and the disclosure of the exclusion of additional elements, limitations, or steps. All numerical values, unless otherwise made clear in the disclosure or prosecution, include either the exact value or approximations in the vicinity of the stated numerical values, such as for example about +/− ten percent or as would be recognized by a person or ordinary skill in the art in the disclosed context. The same is true for the use of the terms such as about, substantially, and the like. Also, for any numerical ranges given, unless otherwise made clear in the disclosure, during prosecution, or by being explicitly set forth in a claim, the ranges include either the exact range or approximations in the vicinity of the values at one or both of the ends of the range. When multiple ranges are provided, the disclosed ranges are intended to include any combinations of ends of the ranges with one another and including zero and infinity as possible ends of the ranges. Therefore, any appended or later filed claims should not be limited to the description of the preferred versions contained herein and should include all such alterations, permutations, and equivalents as fall within the true spirit and scope of the present invention.

What is claimed is:

1. A chair for facilitating rocking and bouncing, the chair comprising:

a seating portion comprising a bouncing mechanism, wherein the bouncing mechanism comprises a round ball member having an interior filled with air;

a base adapted to support the seating portion, the base having a left side having an arm rest and a right side having an arm rest, wherein the base includes a supporting mechanism extending from the left side of the base to the right side of the base, the supporting mechanism supporting a bottom of the round ball member of the bouncing mechanism; and a rocking mechanism adapted to cause the base to rock, wherein the rocking mechanism facilitates the rocking back and forth of a user when the user is seated on the seating portion and wherein the bouncing mechanism facilitates the bouncing of the user when the user is seated on the seating portion, the bouncing being in a bouncing direction that is different than the direction of rocking.

2. A chair according to claim 1 where the rocking direction is in the forward and backward direction.

3. A chair according to claim 1 wherein the bouncing direction is up and down.

4. A chair according to claim 1 wherein the bouncing direction is tilted relative to the up and down direction.

5. A chair according to claim 1 wherein the bouncing direction can be selectively up and down or tilted relative to the up and down direction.

6. A chair according to claim 1 wherein the rocking mechanism comprises one or more arcuate rocker rails.

7. A chair according to claim 1 wherein the supporting mechanism comprises one or more supporting straps.

8. A chair according to claim 1 wherein the bouncing mechanism is filled with compressed air that creates a spring effect when sat on by the user.

9. A chair according to claim 1 wherein the supporting mechanism comprises one or more flexible supporting straps.

10. A chair according to claim 1 wherein the seating portion comprises a top layer of material over the round ball member.

11. A chair according to claim 1 wherein the round ball member is removably insertable into the base.

12. A chair according to claim 1 wherein the chair further comprises a back rest.

13. A rocking and bouncing system for facilitating rocking and bouncing, the system comprising:

a compressible exercise ball;

a base adapted to receive the exercise ball in a manner so that the exercise ball has a seating portion, the seating portion having a surface adapted to be sat on by a user, the base having a left side having an arm rest and a right side having an arm rest, wherein the base includes a supporting mechanism extending from the left side of the base to the right side of the base, the supporting mechanism supporting a bottom of the compressible exercise ball; and a rocking mechanism adapted to cause the base to rock, wherein the rocking mechanism facilitates the rocking back and forth of the user when the user is seated on the seating portion and wherein the exercise ball facilitates the bouncing of the user when the user is seated on the seating portion.

14. A system according to claim 13 wherein the exercise ball is removably insertable into the base.

15. A system according to claim 13 wherein the base has a cavity adapted to receive the exercise ball.

16. A chair according to claim 13 wherein the supporting mechanism comprises one or more supporting straps.

17. A chair according to claim 13 wherein the supporting mechanism comprises one or more flexible supporting straps.

18. A method for facilitating a rocking motion and a bouncing motion of a user, the method comprising:

providing a seating portion comprising a bouncing mechanism, wherein the bouncing mechanism comprises a round ball member having an interior filled with air;

providing a base having a left side having an arm rest and a right side having an arm rest, wherein the base includes a supporting mechanism extending from the left side of the base to the right side of the base, the supporting mechanism supporting a bottom of the round ball member of the bouncing mechanism;

inserting the at least partially spherical member into the base so that it is supported by the supporting mechanism;

having a user sit on the seating portion;

rocking the base and the user seated on the seating portion;

before, during or after rocking the base, facilitating the bouncing of the user on the seating portion.

19. A method according to claim 18 wherein the user is holding a baby while seated on the seating portion.

20. A method according to claim 18 wherein the user is stimming while seating on the seating portion.

* * * * *